US005219173A

United States Patent [19]

Vit et al.

[11] Patent Number: 5,219,173

[45] Date of Patent: Jun. 15, 1993

[54] TARGET PRACTICE SYSTEM

[75] Inventors: Claudio Vit; Francesco Romano, both of Borgo San Dalmazzo, Italy

[73] Assignee: Auser Progetti di Vit Claudio & C. S.N.C., Cuneo, Italy

[21] Appl. No.: 881,014

[22] Filed: May 8, 1992

[30] Foreign Application Priority Data

May 10, 1991 [IT] Italy ..... 000347/91[U]

[51] Int. Cl.[5] ..... F41J 1/16

[52] U.S. Cl. ..... 273/371

[58] Field of Search ..... 273/371, 378, 390-392, 273/403, 404, 407, 408

[56] References Cited

U.S. PATENT DOCUMENTS 3,097,303 7/1963 Ulrich ..... 273/371

4,523,761 6/1985 Huscher ..... 273/371

*Primary Examiner*—Benjamin H. Layno

*Attorney, Agent, or Firm*—Quarles & Brady

[57] ABSTRACT

A target practice system comprising a number of target units, each housing two pasteboard silhouette targets hinged eccentrically and activated so as to rotate between an idle position wherein they are fully concealed by the target unit, and an exposed position wherein they are exposed to fire. Each target unit also comprises a light source to one side of the path of the target as it moves between the idle and exposed positions, and an optical detector on the other side. The light produced by the light source is thus cut off by the target moving between the aforementioned two positions, except for any holes in the target, the presence and location of which is thus detected by the optical detector.

18 Claims, 3 Drawing Sheets

TARGET PRACTICE SYSTEM

BACKGROUND OF THE INVENTION

The present invention relates to a target practice system.

Known target practice systems commonly employ fixed or moving silhouette targets, the latter for improving the speed and reflex action of the user, and involve the use of either real bullets or simulation means such as laser beams.

One known system of the first type (using real bullets) employs silhouette targets pivoting at the bottom and which, when hit, swing down backwards. A drawback of this type of system is that it does not permit detection of the actual point at which the target is hit, as required for practice or competition purposes.

Another known system of the first type employs pasteboard silhouette targets which, being pierceable, show the user exactly where the bullet has hit. In this case, however, the drawback lies in the bullet hole having to be detected by an assistant (or the user), and plugged before the target can be used again.

Known (simulation) systems of the second type, on the other hand, provide, by means of a single control system, for controlling a number of targets and automatically detecting if and where the target is hit. These, however, invariably fail to effectively simulate real shooting conditions, and offer very little versatility in terms of target presentation and range layout.

SUMMARY OF THE INVENTION

It is an object of the present invention to provide a target practice system designed to overcome the aforementioned drawbacks, i.e. which provides for automatically and rapidly determining and classifying the skill of the user; requires no particular assistance for resetting the targets; and enables troublefree target setup as required for simulating real shooting conditions.

According to the present invention, there is provided a target practice system comprising at least one silhouette target unit housing at least one pierceable target movable between an idle and an exposed position; characterized by the fact that is comprises optical means for detecting the location of holes in said target as it moves between said exposed and idle positions.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
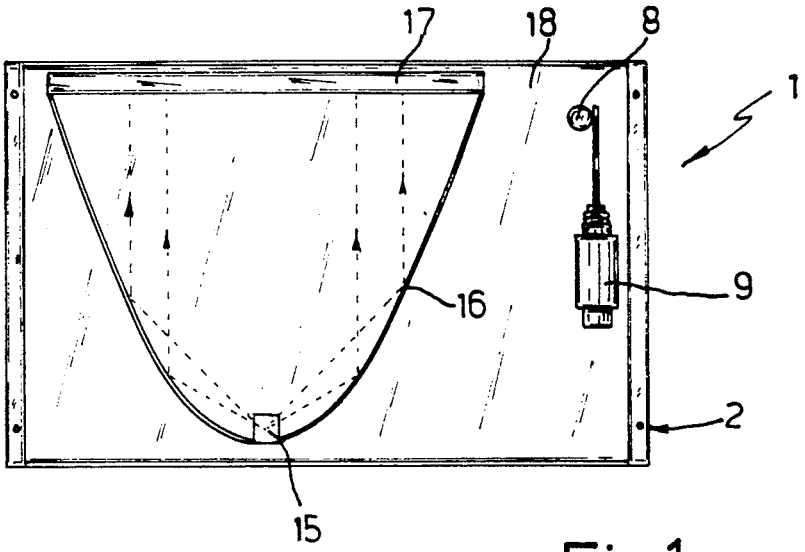
FIG. 1 shows a front view of a target unit with the cover removed.
Figure 2:
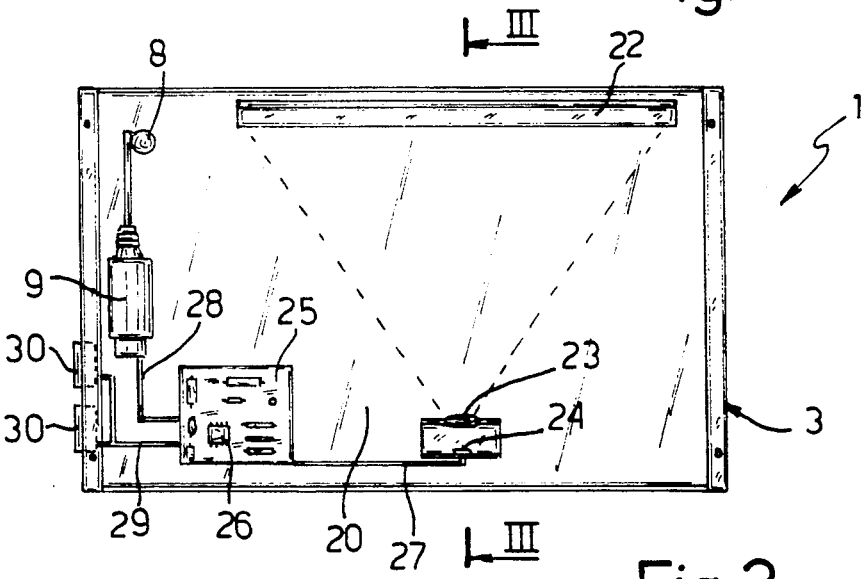
FIG. 2 shows a rear view of the FIG. 1 target unit with the cover removed.

The target practice system according to the present invention comprises a number of silhouette target units 1 as shown in detail in FIGS. 1 to 5.

As shown in FIGS. 1 to 5, each target unit 1 consists of two casings 2, 3 in the form of a flattened parallelepipedon, arranged side by side along the smaller face and connected by spacers 4. The gap between casings 2 and 3 houses two targets 5 and 6, preferably of different colors for differentiating, for example, between "friend" and "foe" surprise targets to be ignored or fired at respectively by the user in known manner.

Figure 5:
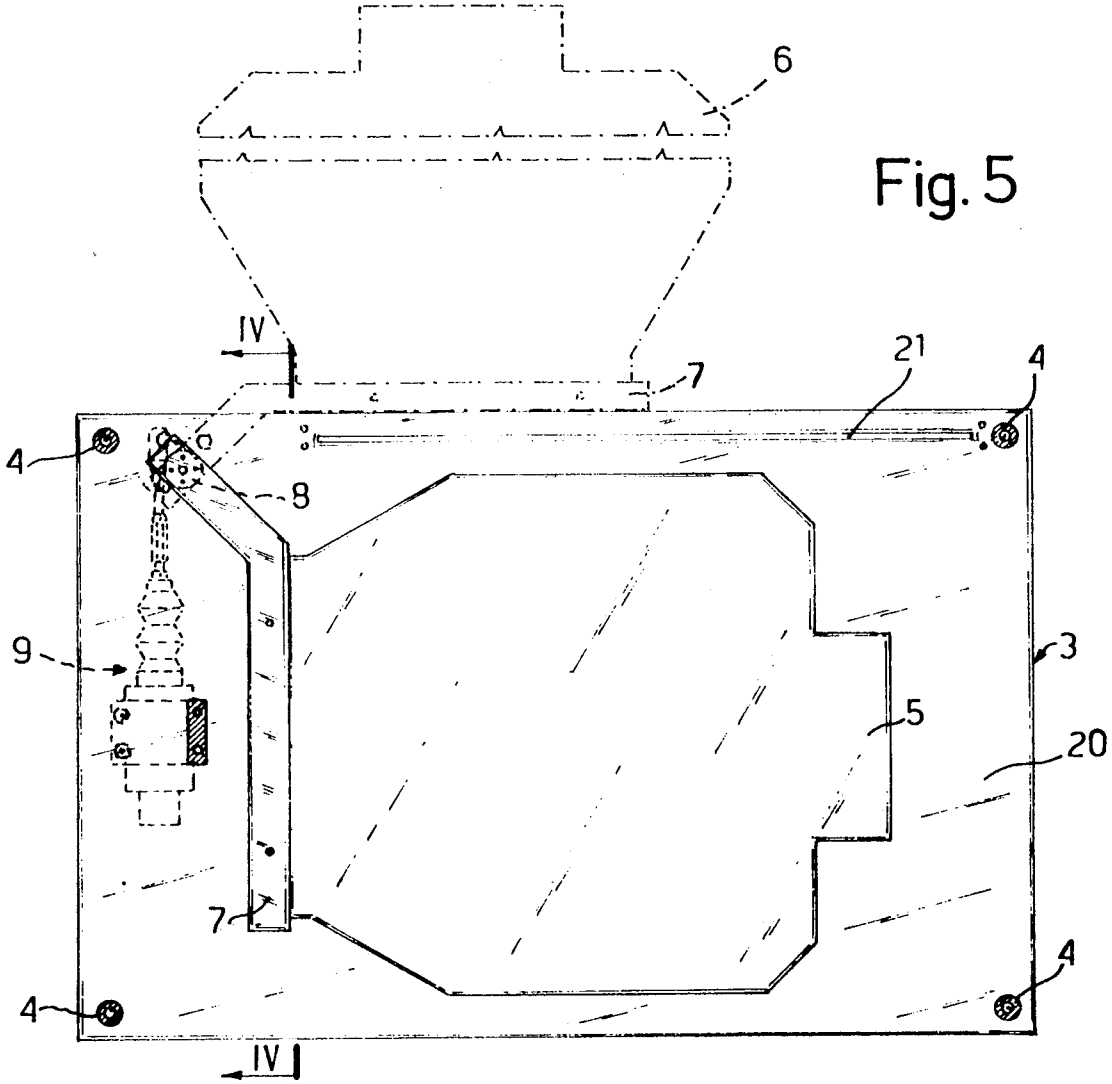
FIG. 5 shows a longitudinal section of the target unit along line V—V in FIG. 4.
Figure 4:
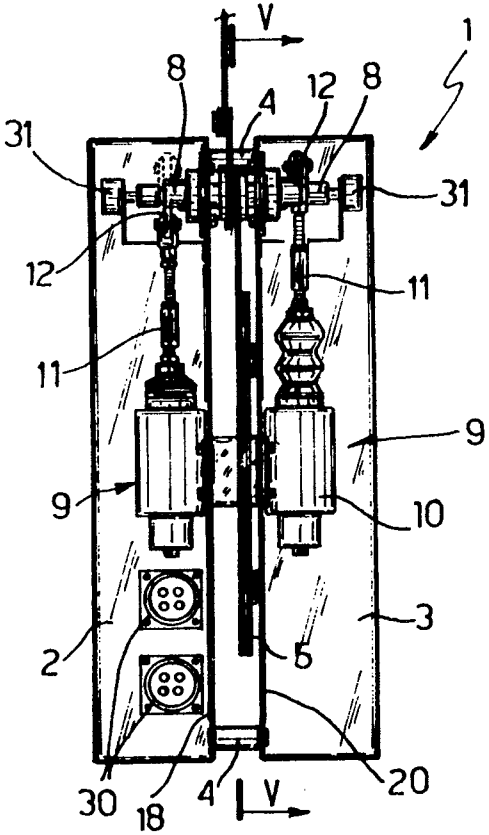
FIG. 4 shows a cross section of the target unit along line IV—IV in FIG. 5.

As shown particularly in FIG. 5, targets 5 and 6, which are made of pierceable material, preferably pasteboard, are hinged to respective casings 2 and 3 by an arm 7, so as to rotate between an idle position wherein they are housed entirely and horizontally inside the gap between casings 2 and 3 (as shown by target 5), and an exposed position wherein they project substantially vertically from said gap so as to approximately simulate a human form (as shown by the dotted line representing target 6).

More specifically, each arm 7 is integral at one end with a respective pin 8 supported for rotation on a respective casing 2, 3 and rotated by an actuator 9 also housed in respective casing 2, 3. As shown by the dotted line relative to target 5 in FIG. 5, and more clearly in FIG. 4, each actuator 9 consists, for example, of an electromagnet 10, which is energized or de-energized for raising or lowering a push rod 11 hinged to one end of a connecting rod 12, the other end of which is integral with pin 8. Pin 8 is connected to a potentiometer 31, the output of which is thus related to the angular position of respective pin 8 and, therefore, respective target 5, 6.

Figure 3:
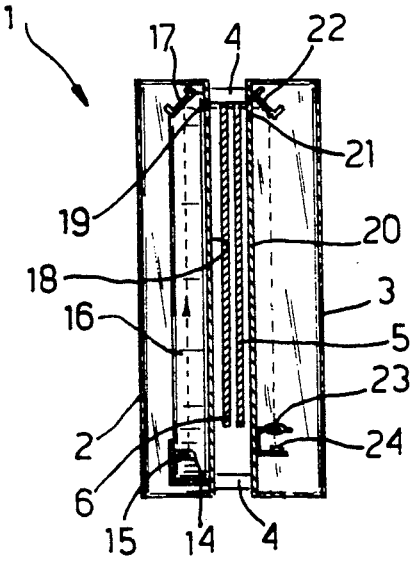
FIG. 3 shows a cross section along line III—III in FIG. 2.

As shown particularly in FIGS. 1 and 3, casing 2 houses a light source, e.g. a lamp 14, supported on an L-shaped element 15 fitted to casing 2, and located at the focal point of a parabolic plate 16 arranged vertically with its concave side facing the top or target output side of casing 2. The inner surface of plate 16 defines a mirror surface for reflecting the light from lamp 14 upwards into a number of parallel rays as shown schematically by the dotted lines in FIG. 1. Close to the top of casing 2, a mirror 17 "closes" the top of plate 16, and is set at a 45° angle so as to deflect the reflected light from plate 16 by 90°, and more specifically on to wall 18 of casing 2 facing casing 3, as shown in FIG. 3. Wall 18 presents an opening 19 exactly opposite mirror 17, for enabling passage of the light into the gap between casings 2 and 3.

Similarly, wall 20 of casing 3 facing wall 18 of casing 2 presents an opening 21 exactly opposite and the same size as opening 19. Behind opening 21, there is provided a diffusor 22 consisting, for example, of a metal section with a flat white painted surface on one side, and also set at a 45° angle (in the opposite direction to mirror 17) for receiving the reflected light from mirror 17, as described in more detail later on, and so locating the hole in the target. Close to the bottom, wall 20 supports a biconvex lens 23 which "covers" the entire surface of diffusor 22, and focuses any light striking diffusor 22 on to an optical detector 24, more specifically, a 1024-element linear CCD detector (such as a NEC MICRO PD 3575D).

Optical detector 24 is connected electrically to a board 25 (FIG. 2) secured to wall 20 of casing 3 and fitted with various components (including a microprocessor 26) for electrically supplying target unit 1 (specifically, actuators 9 and optical detector 24) and determining and memorizing the location of the hole in the target, as described later on. Board 25 is connected by cables 27 to optical detector 24, by cables 28 to actuators 9, by cables 29 to two sockets 30 for mutually connecting different target units 1, and by cables (not shown) to light source 14 and potentiometers 31.

Figure 6:
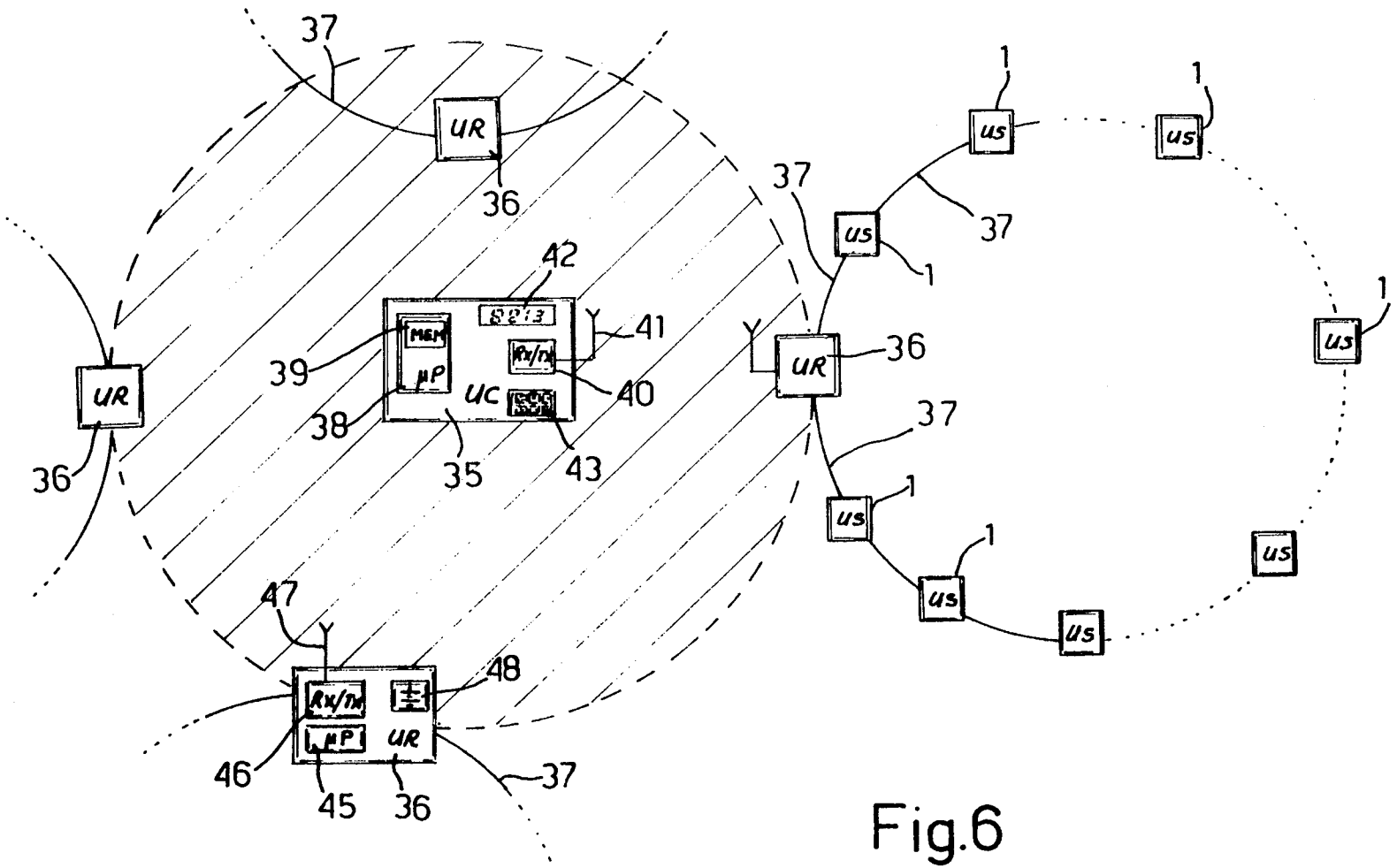
FIG. 6 shows a schematic view of the target practice system as s whole.

As shown in FIG. 6, the target system according to the present invention comprises a structure consisting of a central unit 35 (UC); a number of remote units 36 (UR); and a number of target units 1 (US) for each remote unit. At present, by way of example, provision may be made for a maximum of eight remote units 36, each with a maximum of sixteen target units 1.

More specifically, target units 1 depending on the same remote unit are loop connected by cable, together with the remote unit itself, as shown in FIG. 6. Each socket 30 on each target unit 1 is thus connected to a plug element (not shown) on one end of a cable 37, the other end of which also presents a plug element (not shown) connected to a socket on the adjacent target unit 1 or respective remote unit 36. As each remote unit 36 communicates by radio with central unit 35, units 36 may be located in any manner in relation to central unit 35 within a radius of, say, 2 Km (dotted line in FIG. 6). Cables 37, on the other hand, present a length of, say, 5 m, which therefore represents the maximum distance between adjacent target units 1.

Central unit 35 provides for controlling the operation of each target unit 1, by selecting which of the two targets is to be exposed and for how long; automatically detecting when the target is hit; and classifying the skill of each shooter on the basis of hole location data relative to each target unit, as described later on. Central unit 35 also provides for controlling communication with remote units 36, for which purpose, it presents a microprocessor 38 with a data memory 39 and a program memory; a transceiver unit 40 connected to an aerial 41; a display 42 for displaying data such as the skill level of each shooter; and a keyboard 43 for entering or displaying data, or entering predetermined target routines. Unit 35 also presents a power unit and battery (not shown).

Similarly, each remote unit 36 comprises a microprocessor 45; a transceiver unit 46 connected to an aerial 47; and a power unit 48, with a battery and charging means, for also supplying respective target units 1.

Central unit 35 preferably communicates analogically with remote units 36 over a 457 MHz radio link (for which purpose, transceiver units 40, 46 both contain a modem with D/A and A/D converters), and supplies each remote unit 36 with instructions relative to the target exposure time and mode of each target unit 1. In turn, central unit 35 is supplied with hole location data relative to target units 1; and computes the score of each hit according to the type of target (plus or minus scores for foe or friend targets respectively) and the hole location (according to existing standards or other scoring systems, using maps memorized in a microprocessor 38).

As already stated, each remote unit 36 communicates with respective target units 1 via cable, using a standard EIA 485 multipoint line, and supplies each target with instructions together with a code for identifying the target referred to.

The system described operates as follows.

First, central unit 35 supplies remote units 36 with information relative to the operating sequence of each target unit 1, which targets are to be exposed, and the exposure time of each, according to a practice routine stored in microprocessor 38. Each remote unit then waits for a practice start signal (consisting, for example, of a person walking past a sensor not shown in the drawing), at which point, it supplies the operating instructions to the targets in question.

Depending on the practice routine used, each target unit activates either one of actuators 9 for exposing the relative target. As this swings out (from the gap between casings 2 and 3), it moves between openings 19 and 21, thus cutting off the light beam produced by lamp 14 and reflected by mirrors 16 and 17 on to diffusor 22, and so enabling any existing holes in the target at this stage to be located accurately. In fact, as the target swings out, the beam produced by lamp 14 is cut off along the whole of opening 19, whereas a hole in the target, as it moves past opening 19, allows the beam to filter through and light up a given spot on diffusor 22 (the rest of which is shielded from the light source), which spot is detected by linear optical detector 24 via focusing lens 23. The illuminated elements of detector 24 thus depend on the location on diffusor 22 of the light beam through the exposed target. The information relative to the illuminated elements of the optical detector is supplied over cable 27 to microprocessor 26, which is supplied simultaneously via potentiometer 31 with the rotation angle of the target, so as to compute the hole coordinates in the form of pseudopolar coordinates.

Microprocessor 26 thus provides for memorizing the location of all the existing holes in the target as it swings out, and, similarly, when it swings back (in the opposite direction), and, by comparing the location (and number) of the holes in the target before and after exposure, for determining whether the target has been hit and, if so, the location of the additional hole. The information relative to the hole location is supplied by target unit 1 over cable 37 to respective remote unit 36, according to the set protocol, and by remote unit 36 to central unit 35, which provides for computing the score according to the type of target exposed and the hole location, as already described.

The advantages of the target practice system according to the present invention will be clear from the foregoing description. In particular, it provides for using real firearms under real training conditions, thus catering to professional requirements while at the same time affording greater satisfaction at amateur level. Moreover, automatic optical detection of the hole location as the target is withdrawn eliminates the need for on-the-spot inspection; enables automatic score keeping; and eliminates the need for plugging any existing holes in the target between one round and the next, by memorizing them beforehand. As such, the system according to the present invention also provides for greater safety, in that the target units need only be approached for installation purposes.

The system according to the present invention provides for simultaneously controlling up to 128 target units within a wide operating range, and is extremely versatile by enabling surprise exposure and troublefree repositioning of the targets as required (the only minor limitation being the maximum distance between the target units and between the central and each remote unit). Any number of both indoor and outdoor courses may thus be devised, with different target locations and surprise targets each time. Moreover, the exposure sequence and timing of the target units connected to a given remote unit may be programmed as required for catering to specific training standards, ranging from amateur shooting range to professional field exercises.

Despite being highly flexible, the system according to the present invention is basically straightforward, reliable and relatively easy to install.

To those skilled in the art it will be clear that changes may be made to the system as described and illustrated herein without, however, departing from the scope of the present invention.

We claim:

1. A target practice system comprising at least one silhouette target unit (1) housing at least one pierceable target (5, 6) hinged eccentrically to said target unit and said pierceable target movably rotatable between an idle position, wherein said pierceable target is housed and covered by said target unit and an exposed position wherein said pierceable target projects from said target unit; characterized by the fact that said target unit comprises optical means (14, 16, 17, 22–24) for detecting the location of holes in said pierceable target (5, 6) as it moves between said exposed and idle positions.

2. A system as claimed in claim 1, characterized by the fact that said detecting means (14, 16, 17, 22–24) comprise a light source (14) located on one side of and along the rotation path of said target (5, 6); and an optical detector (24) on the opposite side of said target (5, 6).

3. A system as claimed in claim 2, characterized by the fact that said target unit (1) comprises a first casing (2) housing said light source (14); and a second casing (3) housing said optical detector (24); said first and second casings (2, 3) being arranged side by side with a gap in between, and respectively presenting a first and second opening (19, 21) arranged facing each other; said target (5, 6) being housed in the gap between said first and second casings (2, 3).

4. A system as claimed in claim 3, characterized by the fact that said detecting means (14, 16, 17, 22–24) also comprise a first mirror element (16) including a parabola-shaped reflecting strip, with said light source (14) located in the center of the parabola; and a second linear mirror element (17) located along the path of the light reflected by said first mirror (16) and designed to reflect said light through said first opening (17) and towards sad second opening (21).

5. A system as claimed in claim 3, characterized by the fact that said detecting means (14, 16, 17, 22–24) also comprise an elongated light diffusing element (22) extending along said second opening (21), and having a diffusion surface facing said second opening (21) and a focusing element (23); and a photosensitive detector (24) comprising a number of photosensitive elements; said photosensitive detector (24) receiving the light beam focused by said focusing element (23), and generating an electric signal as a function of the location of said photosensitive elements reached by said beam.

6. A system as claimed in claim 5, characterized by the fact that is comprises actuating means (9) for moving said target (5, 6) between said exposed and idle positions; and processing means (26) for determining the position of said target (5, 6) upon reception of said electric signal.

7. A system as claimed in claim 6, characterized by the fact that said processing means (26) provide for determining the location of any holes in said target (5, 6) on the basis of said target position and said electric signal.

8. A system as claimed in claim 1, characterized by the fact that said target comprises two alternately movable silhouette targets (5, 6).

9. A system as claimed in claim 1, characterized by the fact that it comprises a number of loop connected target units (1).

10. A system as claimed in claim 9, characterized by the fact that it comprises a remote unit (36) series connected to said number of target units (1), for supplying commands relative to exposure of said targets (5, 6), and receiving hole location information from said target units (1).

11. A system as claimed in claim 10, characterized by the fact that it comprises a number of electric cables (37) connecting pairs of adjacent target units (1) and a remote unit (36) to respective adjacent said target units (1).

12. A system as claimed in claim 11, characterized by the fact that said remote units (36) and said respective target units (1) generate serial transmission signals.

13. A system as claimed in claim 10, characterized by the fact that it comprises a number of remote units (36), each series and loop connected to a respective number of said target units (1); and a central unit (35) for supplying the commands relative to exposure of said targets (5, 6) according to predetermined sequences and parameters, and receiving said hole location information.

14. A system as claimed in claim 13, characterized by the fact that said central unit (35) comprises means (38) for computing the score and skill level of the user on the basis of said exposure commands and said hole location information.

15. A system as claimed in claim 13, characterized by the fact that said central unit (35) and said remote units (36) comprise radio transceiver units (40, 46).

16. A system as claimed in claim 15, characterized by the fact that said transceiver units (40, 46) comprise audio band transmission modulating elements.

17. A system as claimed in claim 13, characterized by the fact that said central unit (35) comprises a keyboard (43) for entering data and instructions; and a display (42) for displaying the results.

18. A target practice system comprising at least one silhouette target unit housing at least one pierceable target movable between an idle position, wherein said pierceable target is housed and covered by said target unit and an exposed position wherein said pierceable target projects from said target unit; characterized by the fact that said target unit comprises optical means for detecting the location of holes in said pierceable target as it moves between said exposed and idle positions, further characterized by the fact that said target unit comprises means (25) for memorizing the location of any holes in said pierceable target (5, 6) as said pierceable target moves from said idle to said exposed position; means for comparing the hole locations in said pierceable target (5, 6), as said pierceable target moves back from said exposed to said idle position, with said memorized hole locations; and means for memorizing the location of any additional holes during the return movement of said pierceable target (5, 6).

* * * * *